US006172031B1

(12) United States Patent
Stevens

(10) Patent No.: US 6,172,031 B1
(45) Date of Patent: Jan. 9, 2001

(54) COMPOSITIONS AND METHODS FOR USE IN CLEANING TEXTILES

(76) Inventor: Edwin Stevens, 30 Brookside Rd., West Orange, NJ (US) 07052

( * ) Notice: Under 35 U.S.C. 154(b), the term of this patent shall be extended for 0 days.

(21) Appl. No.: 08/953,307

(22) Filed: Oct. 17, 1997

(51) Int. Cl.[7] ..... C11D 3/20
(52) U.S. Cl. ..... 510/417; 510/506; 510/505
(58) Field of Search ..... 510/417, 423, 510/424, 505, 506

(56) References Cited

U.S. PATENT DOCUMENTS 3,941,712 * 3/1976 Ferrara et al. ..... 252/126
4,180,472 * 12/1979 Mitchell et al. ..... 252/162
5,089,269 * 2/1992 Noda et al. ..... 424/456

FOREIGN PATENT DOCUMENTS

177183 A1 * 4/1986 (EP) .
511652 A1 * 11/1992 (EP) .

* cited by examiner

*Primary Examiner*—John R. Hardee
(74) *Attorney, Agent, or Firm*—Henry D. Coleman; R. Neil Sudol

(57) ABSTRACT

The present invention relates to compositions and methods of removal of contaminants from textiles and related fabrics and garments. The present cleaning compositions contain at least one vegetable oil ester or fatty acid ester and a surfactant in combination with water and rinse compositions which are also preferably employed in a method aspect comprise at least one glycol ether or glycol acetate and water.

20 Claims, 1 Drawing Sheet

BASKET
RINSE TANK
RINSE TANK
TANK (OPTIONAL
STILL
WORK TANK
GRAVITY SEPARATOR
OIL COLLECTOR
CENTRIFUGAL (Disk) FILTER w/ Filter Media
1
2
3
4
5
6
7
8
9
FREQUENCY OPTIONAL
EACH WASH CYCLE

COMPOSITIONS AND METHODS FOR USE IN CLEANING TEXTILES

FIELD OF THE INVENTION

The present invention relates to compositions and methods for removing stains, grease, fatty acids, oil and soil, among other contaminants, from textiles, fabrics and garments normally encountered in the dry cleaning industry, in particular, commercial and industrial uniforms, fabrics and garments normally encountered in the uniform rental business. The present invention also relates to degreaser formulations for use in removing grease and oil from equipment, machinery and the like. In addition, the present invention may also be used to separate and concentrate oil removed from garments, obviating the need to dispose of it as a perchlorethylene contaminated hazardous waste.

BACKGROUND OF THE INVENTION

Garments and other fabrics, including carpeting curtains, etc. become soiled with stains, fatty acids and other contaminants which attach to dust attracted to the garment during the normal course of wear.

Industrial uniforms become soiled with grease, oil, blood and other microbial contaminants. At present uniforms are cleaned by use of perchloroethylene (dry-cleaning) or by laundering. Laundering uses 1.2 gallons of water for each pound of clothing cleaned, requiring large energy inputs for heating, and resulting in large discharges of detergent and oil contaminated water. A typical industrial laundering operation washes a 400 lb. load. This would require 816 liters of water for washing and rinsing. Laundering operations typically utilize four rinses, the last rinse at temperatures of 200° F. Assuming that the temperature of source water measures between 40° F. (4.4° C.) and 50° F. (10° C.) each wash cycle requires approximately 70,000 KCalories of heated water. Since this water is discarded, the energy is lost.

The discharges usually require installation of a water treatment facility on-site or they are made directly to a P.O.T.W. (Publicly owned treatment works). Most states require installation of on-site water treatment facilities.

Cleaning with perchloroethylene results in an exponential expansion of effluent in the form of oil contaminated perchloroethylene which must be handled and treated as hazardous waste.

The most frequently used solvent in the world for textile cleaning today is perchloroethylene. White mineral spirits and trichloroethylene, formerly of great significance, have, with the exception of China and Japan, have now virtually disappeared. In recent years two fluorocarbons, R113 and R11, entered the market for use as solvent cleaners; however, their use has been limited and is expected to end because of the Montreal Protocol, restricting and ultimately banning production of chlorofluorocarbons (CFC's), beginning in 1996.

The attendant deleterious safety and/or environmental effects of perchloroethylene makes it disadvantageous for use as a cleaning solvent. Organohalogens in general are environmentally suspect, but perchloroethylene use presents an additional set of concerns because of its high specific gravity of 1.626 (density 13.49 lbs/gal) and its high vapor pressure. Because the density of perchloroethylene is far greater than that of water (8.33 lbs/gal) and because it is clearly not biodegradable, perchloroethylene spillage presents a threat to groundwater with effects lasting many years. Moreover, in many instances in mixed use buildings, air emission guidelines are not met, even with new dry cleaning equipment. The recent problems documented in New York State show that the use of perchloroethylene is of ongoing concern.

White or mineral spirits, which are presently used in Japan and China, as well as other petroleum based solvents present a hazard and exhibit a proclivity to catch fire or even explode in dry cleaning equipment. This is a too-frequent occurrence in Japan where these solvents are in heavy use.

Typical prior art semi-aqueous washing processes employ two steps. The first step is a water-immiscible solvent wash step followed by a second step aqueous rinse. The second step is generally required because the solvents used in this process, unlike perchloroethylene or the CFC's, generally are not volatile and will not evaporate.

Degreaser compositions are presently used in various industrial settings to remove grease and oil from equipment, machinery and related metal-containing objects. Degreasers are used in the aircraft and automobile industry and the market is considered large worldwide. Presently, the primary degreaser solvent is perchloroethylene and other non-biodegradable chlorinated hydrocarbons are also used. The environmental hazard created by the use of these chlorinated degreasers complicates their use and has made them undesirable.

OBJECTS OF THE PRESENT INVENTION

It is an object of the present invention to provide compositions for cleaning textiles in clothing and related articles, especially commercial uniforms and gloves.

It is an additional object of the present invention to provide compositions which are substantially biodegradable and are effective substitutes for cleaning solvents which presently find use in cleaning processes and for use as degreasers for machinery and related equipment.

It is another object of the present invention to provide methods for cleaning textiles in garments and related articles which make use of the present compositions.

These and other objects of the invention may be readily gleaned from the description of the present invention which follows.

SUMMARY OF THE INVENTION

The present invention relates to compositions and methods of removal of contaminants from textiles and related fabrics and garments and grease and oil from machinery and related equipment utilizing compositions which pose no significant risk to ground-water, are environmentally compatible and which are substantially biodegradable. Compositions according to the present invention preferably are substantially non-toxic, substantially biodegradable liquids at room temperature or higher and are effective in removing substantial quantities of contaminants from fabrics, especially including garments such as uniforms and commercial gloves.

Compositions according to the present invention avoid the use of perchloroethylene, mineral spirits or chlorinated fluorinated hydrocarbons (CFC's). The present compositions may be utilized as effective substitutes for perchloroethylene in commercial cleaning processes and as degreasers.

The present compositions have many of the favorable physical and chemical characteristics of perchloroethylene without the attendant unfavorable characteristics, most notably, the environmental incompatibility of perchloroethylene.

The present compositions preferably are compatible for use with cleaning equipment with minor modification and are also capable of being regenerated after a cleaning operation, usually by simply separating an oil layer (preferably, by centrifugation) from the remainder of the cleaning composition. The present compositions may accommodate surfactants which may aid the removal of fatty acids, stains and other contaminants from fabrics, especially clothing. In addition, the present compositions are compatible with most, if not all, of the commercial fibers used in fabrics. Like perchloroethylene, the present compositions advantageously do not substantially change the shape or deform the underlying fibers of the cloth. Compositions according to the present invention are generally stable during cleaning operations and at drying and separation temperatures.

Cleaning compositions according to the present invention comprise:

(i) about 5% to about 70% by weight of a vegetable oil or fatty acid ester;

(ii) about 0.001% to about 25% by weight of at least one surfactant; and (iii) about 20% to about 95% by weight water.

Compositions according to the present invention are preferably in the form of an emulsion.

Preferred amounts of vegetable oil or fatty acid ester for use in the present cleaning compositions range from about 5% to about 60% by weight, more preferably about 10% to about 50% by weight, even more preferably about 15% to aout 45%, even more preferably about 15% to about 35% by weight. Preferred amounts of surfactant for use in the cleaning compositions according to the present invention range from about 0.2% to about 15% by weight, more preferably about 0.5% to about 10%, even more preferably about 0.5% to about 8% by weight. The amount of water in the cleaning compositions according to the present invention preferably ranges from about 40% to about 90% by weight, more preferably about 50 to about 85% by weight, more preferably about 50% to about 85% by weight, even more preferably about 60 to 85% by weight and even more preferably about 65% to about 80% by weight.

Compositions according to the present invention may optionally include at least one component selected from the group consisting of, for example, a dibasic ester, a terpene, a glycol ether or glycol ether acetate, an antimicrobial agent, a fabric finishing agent or mixtures, thereof.

Compositions according to the present invention have densities which are generally less than that of water and are preferably biodegradable, preferably with BOD's of greater than about 20 ppm, more preferably greater than about 40 ppm. The present compositions are particularly environmentallly advantageous because they are readily biodegradable and they are lighter than water. As such, the present preferred compositions pose little, if any risk to contaminate groundwater. In addition, the present compositions are generally significantly less toxic than is perchloroethylene.

The present invention also relates to a method for cleaning contaminants from textile materials, such as fabric in clothes, especially uniforms and gloves. In the method aspect of the present invention, the invention employs a two step wash process involving a first wash step (wash cycle), followed by a second step involving the rinsing from fabric of solvent applied during the wash step. In alternative embodiments, textile materials to be washed are first exposed to a conditioning solution, and the conditioning solution is followed by a wash step, as described above, followed by a rinse step. In the present method, contaminated fabric is exposed to at least one wash cycle using one or more of the present cleaning compositions for a time effective to substantially clean or remove contaminants from the fabric, and subsequently, the cleaning composition is substantially removed from the fabric in an extraction step (preferably, by rotating the cleaning cage containing the garments at high speed) which is followed by a rinse step, which removes substantially all remaining cleaning composition from the treated fabric. In a subsequent drying step, the cleaned fabric is purged of rinse composition in an extraction step (high speed rotation) and exposed to an elevated temperature (i.e., generally higher than room temperature) to substantially remove any remaining rinse composition from the fabric. Optional steps in the method include the removal of a soil/contaminant layer from the cleaning composition after it has been used to clean a contaminated fabric (top or bottom separation, but preferably top separation) and/or distilling the contaminated solvent after the fabric is cleaned. In a further step, contaminated cleaning composition may be regenerated (i.e., contaminant may be removed) by centrifuging the contaminated composition or using other means to separate the contaminants from the cleaning composition.

In another aspect of the present invention, the contaminants which are separated from the cleaning composition after use and which often include oil and related hydrocarbons may be used as fuel, thus obviating the need to dispose of the contaminants as hazardous waste.

In related methods, for cleaning carpet and other textiles, the compositions of the present invention may simply be placed in contact with the soiled fabric, agitated (including wiping the soiled fabric) and then dried either at elevated temperature or at ambient temperature.

During the cleaning process, the present compositions solubilize the fabric contaminants, especially oil and grease and soil containing fatty acids and food contaminants, and remove the contaminants from garment fabrics to which they attach. When the contaminants, especially oils and fatty acids, are further solubilized in the present compositions, which may include water-insoluble, oil-soluble surfactants, the contaminants become separated from the water in at least two layers, preferably only two layers, which facilitates the separation of contaminated cleaning composition. Once separated into distinct layers, the water layer and contaminated cleaning composition layer may be readily separated in a gravity separator, and the contaminated cleaning composition obtained from the gravity separator may be exposed to a further separation step (for example, utilizing centrifugation) wherein the cleaning composition is regenerated upon separation from the contaminants, which, in preferred embodiments, may become a fuel source.

Cleaning preferably takes place at raised temperatures, preferably at temperatures ranging from about 60° C. to about 80° C., more preferably about 70° C. within this temperature range (but cleaning temperatures may be higher or lower than this range, which temperature may include room temperature or even lower temperatures) for a period of at least about one minute, preferably about two minutes to twenty minutes or longer, most preferably about five to about ten minutes, after which time an extraction step takes place to remove residual solvent by rotating the cleaning cage at high speed (analogous to a spin cycle in a washing machine, but preferably at a higher speed). After the extraction step, garments may contain approximately 0.5% to about 25% (often, from about 2% to about 10%) by weight residual cleaning composition, which may include a substantial portion of water. The remaining composition in the garments or textiles is removed from the load of clothing by employing at least one and preferably two rinse steps, wherein the garments or textiles which have been cleaned are separately subjected to at least one rinse step, and preferably, two rinse steps, employing a rinse composition, which generally comprises water and a glycol ether such as, preferably, propylene glycol methyl ether. After each rinse step, the garments or textiles are subjected an extraction step preferably at approximately room temperature to physically remove as much rinse composition from the garments as is possible prior to a drying step. Thereafter, rinsed garments are preferably exposed to a drying step to remove any residual rinse composition wherein a heated air flow or other means of evaporation (generally, at a temperature of less than about 80° C., preferably less than about 65° C., more preferably less than about 60° C.) are utilized to volatilize rinse composition from the cleaned garments/textiles after the extraction step. During this convection process, circulated air heats the load and takes vaporized solvent composition to a recovery condenser in the dry cleaning machine. From there condensate flows to one or more rinse tanks (solvent tanks), depending upon the number of rinse cycles or compositions which are used.

The present invention preferably also has the advantage of permitting top or bottom separation of water, oil, dyes, grease, soil and effluent removed from garments, without distillation and without use of chlorinated solvents as is the current practice in the industry. If distillation is used, it is performed preferably at a temperature of about 150° C. or less, more preferably at about 125° C. or less (although the temperature of the pot containing solvent to be distilled may be substantially higher). In the present invention, because any residual matter remaining after the extraction and/or rinse step would not normally contain hazardous materials (no hazardous or chlorinated materials are generally used in the present compositions), it is expected that the residue obtained from the cleaning composition, in most instances, would not involve hazardous waste disposal as is the current requirement for machines using perchloroethylene.

DETAILED DESCRIPTION OF THE INVENTION

Figure 1:
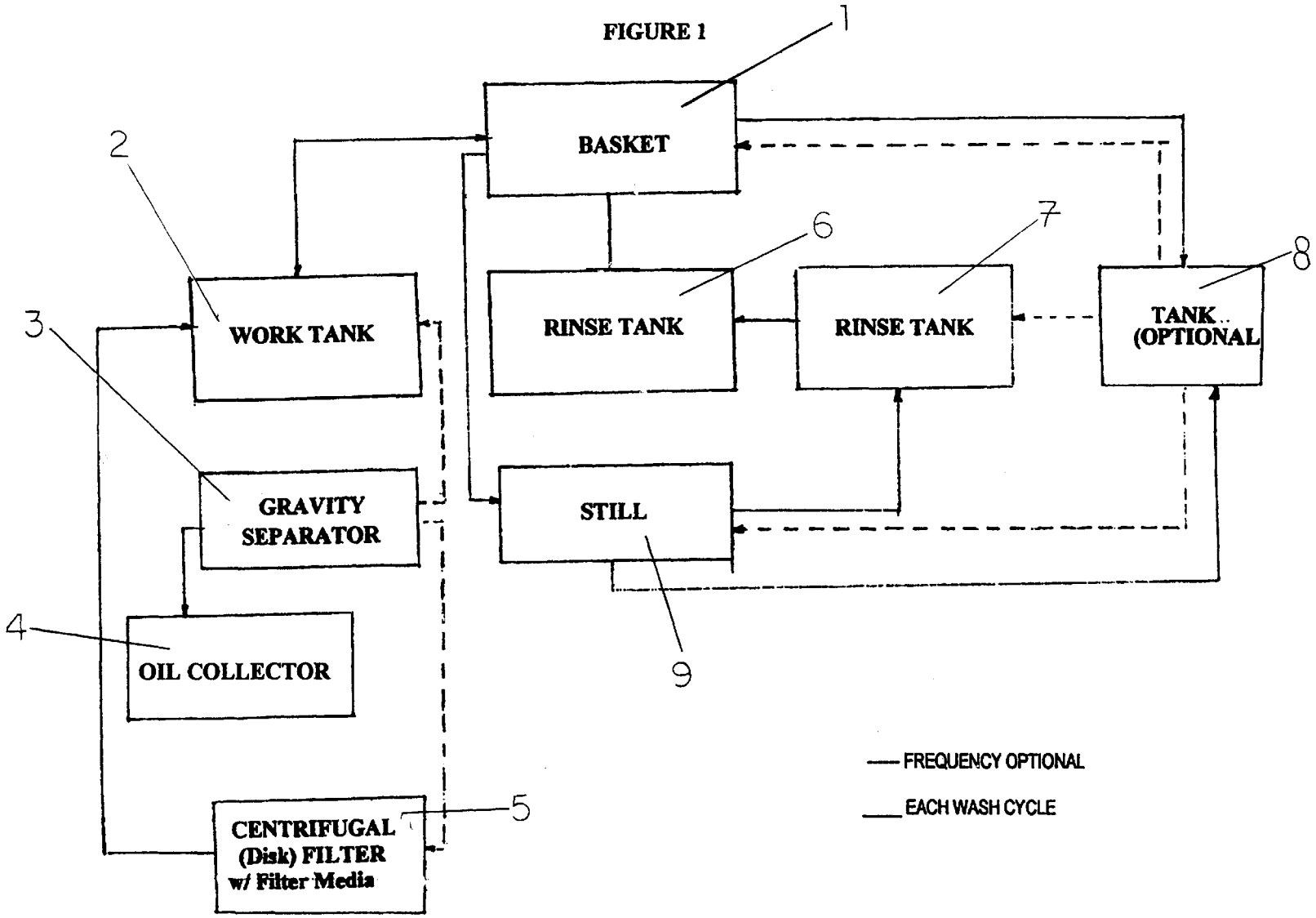
FIG. 1, the sole FIGURE of this application, is a block diagram of a cleaning machine for performing a cleaning method using a cleaning composition as described herein, all in accordance with the present invention.

The following definitions will be used throughout the specification to define the present invention.

The term "contaminant(s)" shall be used to describe most substances which are not normally found in fabrics or other flexible and inflexible surfaces such as machinery and metal surfaces in their clean, uncontaminated state and are generally removed from fabrics or other surfaces during cleaning processes. Contaminents include fats, fatty acids, in particular, triglycerides and fatty acids, fat-like substances, salts, food remnants, sweat, blood, stains, soil, oil, grease and related lubricants and numerous other synthetic and natural or biological contaminants or lubricants which are normally not found on the surfaces and textiles to be cleaned according to the present invention. The most common contaminents which are removed by compositions according to the present invention include triglycerides, fatty acids and related fatty food contaminants and grease, oil and related lubricants. One of ordinary skill will recognize that the instant invention will be effective in removing a wide variety of surface contaminants; however, in many instances, depending upon the chemical nature of the contaminant, the present compositions may need to be modified within the teachings of the invention in order to maximize removal of a particular contaminant.

The term "textile(s)" and "fabric(s)" are used to describe cloth and related material comprised of natural and synthetic fibers which are used to make garments, clothing, carpeting, cloth covering and related cloth-containing items. Textiles which may be compatible for use with the present compositions include textiles made from natural and synthetic fibers and yarns, such as silks, cottons, wool, leather, fur, alpaca, llama, camel, cashmere, angora, vicuna, guanaco, other animal hair, kapok, linen, hemp, jute, manila, alfa, coconut, broom, kenaf, ramie, sisal, polyesters, acetates, triacetates, rayon, rayon-acetates, cellulose, polypropylene-cellulose, alginates, cupro (regenerated cellulose), modal, regenerated protein fiber, polyacryl, polychloride, fluorofiber, modacryl, polyacrylonitrile, polyamide (including nylon), polyethylene, polypropylene, polyurea, polyurethane, vinylal, trivinyl, elastodiens, elasthane, and mixtures of these natural and synthetic fibers, among others.

The term "fatty acid ester" is used in the present specification to describe esters of the general structure:

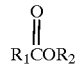

where $R_1$ is a $C_1$ to $C_{30}$ straight- or branch-chained unsubstituted or substituted alkyl, a straight- or branch-chained unsubstituted or substituted alkylene group (such group containing at least one unsaturated carbon-carbon double bond) or a phenyl or substituted phenyl containing group, and $R_2$ is a $C_1$ to $C_{30}$ straight or branch chained unsubstituted or substituted alkyl, or a straight or branch-chained unsubstituted or substituted alkylene group (such group containing at least one unsaturated carbon-carbon double bond) or a pheny or substituted phenyl group, with the proviso that when $R_1$ contains only one to seven carbons, $R_2$ contains at least 8 carbons and when $R_2$ contains only one to seven carbons, $R_1$ contains at least 8 carbons. In preferred embodiments, $R_1$ is a $C_{12}$ to $C_{30}$ straight- or branch-chained substituted or unsubstituted alkyl or alkylene group, more preferably a $C_{14}$ to $C_{26}$ straight chained unsubstituted alkyl group. In preferred embodiments according to the present invention $R_2$ is preferably a $C_1$ to $C_4$ straight- or branch-chained alkyl group, more preferably a methyl, ethyl group, propyl or isopropyl group and most preferably a methyl or ethyl group. Representative fatty acid esters which may be used in the present invention include those which are derived from linoleic, oleic, stearic, caprylic, capric, lauric, muyristic, palmitoleic, ricinoleic, arachidic, gadoleic, arachidonic, behenic, lignoceric and related acids, among others.

The term "vegetable oil ester" is used in its normal definition to describe typical vegetable oils which have been esterified to produce methyl or related esters. The vegetable oil esters of the present invention generally comprise fatty esters derived from triglycerides found in vegetable oils which have been transesterified with methanol, ethanol, isopropanol and related alcohols (from $C_1$ up to about $C_{30}$ straight or branch chained alcohols). Most preferably, the alcohol which serves as a reactant in the transesterification is methanol, ethanol or isopropanol, most preferably methanol. Thus, vegetable oil esters contain predominantly fatty acid esters which are derived from vegetable oils. A preferred vegetable oil methyl ester for use in the present is soygold 1000 available from AG Environmental, which contains is prepared from the transesterification of soybean oil with methanol and contains a mixture of methyl ester fatty acids derived from palmitic acid, stearic acid, oleic acid, linoleic acid and linolenic acid. Vegetable oils having saponification values between about 176 and 250 are ideal and include, for example, almond, avocado, castor, coconut, corn, cottonseed, olive, peanut, persic, rice bran, safflower, sesame, soybean, sunflower and walnut oils, among numerous others may also be used to prepare the fatty acid esters for use according to the present invention. While not being limited by way of theory, it is believed that the fatty acid esters, because of their significant lipophilicity solubilize grease and oils other hydrophobic contaminants in the samples to be cleaned.

The term "surfactant" or "surfactant system" is used throughout the specification to describe that compound or compounds which are used to compatibilize the hydrophobic component of the composition fatty acid with quantities of water which are used in the present invention. In particular, in preferred embodiments according to the present invention, the surfactants are used either alone or in combination to create an emulsion from the hydrophobic components and the water. The amount of surfactant(s) which is used in the present invention to create an emulsion from the hydrophobic component and the water is that amount which is effective for producing an emulsion. The term "emulsion" is used to describe compositions according to the present invention wherein two immiscible liquids, in this case the hydrophobic components containing fatty acid esters and related hydrophobic compounds and water, form one apparent phase, and in certain embodiments, a milky phase. Preferred emulsions according to the present invention comprise a microscopically heterogeneous mixture of the two immiscible liquids, in which one liquid forms minute droplets suspended in the other liquid.

Cleaning compositions according to the present invention comprise at least one surfactant, preferably in an amount effective to create an emulsion (i.e., a single apparent phase) from the hydrophobic phase (which contains at least a fatty acid ester) and water. Surfactants are included in compositions according to the present invention for their ability to solubilize and/or emulsify contaminants to be removed from the textiles to be cleaned, to compatibilize the hydrophilic and hydrophobic components of the present compositions, especially water and the fatty acids esters. The use of an appropriate surfactant mixture may also aid the separation of excess or undesired quantities of water from the present compositions after a cleaning step or after storage.

Surfactants to be included in compositions of the present invention may be anionic, cationic or nonionic surfactants. In addition, certain preferred surfactants according to the present invention are zwitterionic (i.e., they may comprise a salt which is formed from the reaction of an amine and an acid, preferably a carboxylic acid, phosphoric acid or sulfonic acid). Generally, one or more surfactants are included in the present compositions in an amount effective to emulsify and compatibilize the components of the composition, such amount generally comprising about 0.001% to about 25% or more by weight of the final composition (which composition includes water), preferably about 0.2% to about 10% by weight, more preferably about 0.5% to about 8% by weight of the final composition. Numerous surfactants may be employed in compositions according to the present invention, with the proviso that the surfactant or surfactant (s) employed aids in compatibilizing the hydrophobic and hydrophilic parts or components of the present invention. Surfactants for use in the present invention include, but are not limited to, one or more linear or branched chain alcoholic ethoxylates and ethoxysulfates, alcohol ethoxylates, polysorbate esters, ethoxylated alkylphenols, for example, polyethoxynonylphenols, phenoxypolyalkoxyalcohols, for example, nonylphenoxypoly(ethyleneoxy)ethanol and nonylphenoxypolyethoxyethanol, alkyl and alkyl ether sulfates and sulfonates, for example, dodecylbenzenesulfonic acid, alkyl and dialkyl succinate compounds, phosphate esters, for example phosphate esters of long-chain alcohol ethoxylates and combinations of these surfactants.

Other surfactants for use in compositions of the present invention include the phosphate ester surfactants, for example PD-600™, an alkaline stable mixture of mono and di-substituted phosphate esters of decylalcoholethoxylate, available from Chemax, Inc. (Greenville, S.C.) and the Tryfac™ phosphate esters, a series of phosphate ester surfactants as the free acids or various salts, available from Emery Chemicals, Mauldin, S.C. Alkylamine dodecylbenzenesulfonate, Ninate 411™, available from Stepan Company, as well as the substituted benzene sulfonate surfactants such as Bio-soft N-300™ and Biosoft N-411™, also available from Stepan, among others, may also be used in the present invention. Preferred surfactants include polyoxyethylenenonylphenol (NP-6™ and NP-9™), available from Chemax, Inc., Greenville, S.C.) as well as the nonionic alkylphenoxypolyoxyethylene alcohols, the Makon™ series, available from Stepan Company, Northfield, Ill.

Other preferred surfactants include the nonylphenolethoxylate surfactants, which are obtained from the reaction product of ethylene oxide and nonylphenol. The number of moles of ethylene oxide reacted with nonylphenol determine the length of the polyethyleneoxide side chain, the hydrophilicity of the polyethyleneoxide side chain (the longer the chain, the more hydrophilic) and the overall hydrophilicity or hydrophobicity of the final surfactant compound used.

As indicated above, anionic, nonionic and cationic surfactants may be employed for use in the present invention. Nonetheless it is preferable to employ nonionic surfactants and in particular, the alkylphenolethoxylate surfactants, more preferably, the nonylphenolethyoxylate surfactants as at least one surfactant in the present compositions. Nonylphenolethoxylate surfactants may also be used in the present invention, including, for example, nonylphenolethoxylate surfactants which are sold under the tradenames Makon 4, Makon 6, Makon 8, Makon 10 and Makon 12, available from Stepan Company, Northfield, Ill., as well as the nonylphenolethoxylate surfactants Surfonic N-60 and N-100, also commonly known as Poly(Oxy-1,2-ethanediyl), Alpha-(Nonylphenyl)-Omega-Hydroxy-, or Alpha-(Nonylphenyl)-Omega-Hydroxy-Poly(Oxy-1,2-ethanediyl). Mixtures of these and other surfactants are also contemplated for use in the present compositions. In certain compositions according to the present invention, other preferred surfactants may be included, such as fluorocarbon surfactants, as examplified by FC-129, FC-171 and FC 430, available from 3M, with FC-129 being the preferred fluorocarbon surfactant.

The selection of a surfactant system for the present compositions is important to produce emulsified compositions which have compatibilized the disparate chemical components into a relatively uniform mixture. The surfactant system also influences the ability of the final compositions to expunge water after a certain level of water is reached. Different solvent systems dispersion requires different types and levels of surfactants. Combinations of non-ionic and zwitterionic surfactants are generally more effective in some systems than either used alone, as is clearly indicated in the examples section which follows. In such systems, the use of one or more nonionic surfactant, especially a nonylphenolethoxylate surfactant, was preferred.

The term "zwitterionic surfactant" is used throughout the specification to describe components of the cleaning compositions according to the present invention which are added to provide further surfactant-like qualities to the present compositions. Zwitterionic surfactants are surfactants which contain both a positive and negative charge. Zwitterionic surfactants for use in the present invention include compounds which are prepared from the reaction of an amine with a fatty phosphoric acid ester, fatty sulfonic acid or fatty carboxylic acid. Zwitterionic surfactants according to the present invention include those surfactants having a general chemical structure:

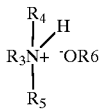

Where $R_3$, $R_4$ or $R_5$ is H, a $C_1$–$C_3$ alkyl, or a $C_1$–$C_5$ alkanol, preferably $R_3$, $R_4$ and $R_5$ are each alkanol and most preferably $R_3$, $R_4$ and $R_5$ are each ethanol;
$R_6$ is a fatty sulfonate of the structure:

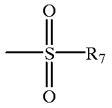

where $R_7$ is a $C_6$–$C_{40}$ alkyl, substituted alkyl, phenyl alkyl or substituted phenyl alkyl;
a phosphate ester of the structure:

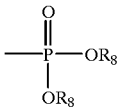

where $R_8$ is a $C_6$–$C_{40}$ alkyl, substituted alkyl, phenyl alkyl or substituted phenyl alkyl;
or a fatty carboxylate of the structure:

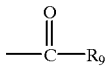

where $R_9$ is a $C_6$–$C_{30}$ alkyl, substituted alkyl, phenyl alkyl or substituted phenyl alkyl.

Preferred zwitterionic surfactants are those which are derived from a fatty sulfonic acid (i.e. a $C_8$ to $C_{30}$ alkyl sulfonic acid), for example linear dodecylbenzenesulfonic acid and an amine, preferably, triethanol amine. In preferred embodiments, the zwitterionic surfactant is triethanolammonium dodecylbenzenesulfonate. Additional preferred zwitterionic surfactants include, for example, ammonium mono- and diester phosphate zwitterionics, especially those based on alkyl mono- and diester phosphate (phosphoester and phosphodiester) surfactants. Compositions according to the present invention (which composition includes water) preferably contain about 0.001% to about 25% or more by weight of at least one zwitterionic surfactant, preferably about 0.2% to about 10% by weight, more preferably about 0.25% to about 8% by weight of the final composition and most preferably about 0.5% to about 5% by weight of the final composition.

The term "rinse composition" is used throughout the specification to describe compositions which are used in an optional step, after a first cleaning or washing step, to remove any residual cleaning composition from the textiles which were treated in the first cleaning step. Rinse compositions according to the present invention comprise a glycol ether or a glycol ether acetate or mixtures, thereof, or preferably, a mixture of water and a glycol ether and/or glycol ether acetate, wherein said water ranges from about 5% to about 95% by weight of the rinse composition and the glycol ether and/or glycol ether acetate ranges from about 5% to about 95% by weight of the rinse composition. Preferred rinse compositions comprise about 25% to about 85% by weight water, more preferably about 50–85% water, the remainder of the composition preferably comprising at least one or more glycol ether and/or glycol ether acetate. Particularly preferred rinse compositions according to the present invention include about 65–80% water and about 20–35% by weight of a glycol ether and/or glycol ether acetate. Preferred glycol ethers for use in the present invention include those which are capable of being distilled such as propylene glycol methyl ether (PM) and propylene glycol n-propyl ether (PnP) being especially preferred.

The terms "glycol ether" and "glycol ether acetate" are used throughout the specification to describe certain preferred components which are used in rinse compositions according to the present invention. Primarily, ethylene glycol ethers and ether acetates and propylene glycol ethers and ether acetates may be used in this aspect of the present invention. Exemplary glycol ethers for use in the present invention, include, without limitation, ethylene and propylene glycol substituted ethers, such as ethylene glycol methyl ether, diethylene glycol methyl ether, triethylene glycol methyl ether, ethylene glycol ethyl ether, diethylene glycol ethyl ether, triethylene glycol ethyl ether, ethylene glycol n-propyl ether, diethylene glycol n-propyl ether, triethylene glycol n-propyl ether, ethylene glycol isopropyl ether, diethylene glycol isopropyl ether, triethylene glycol isopropyl ether, ethylene glycol n-propyl ether, diethylene glycol n-propyl ether, triethylene glycol n-propyl ether, ethylene glycol n-butyl ether, diethylene glycol n-butyl ether, triethylene glycol n-butyl ether, propylene glycol methyl ether (PM), dipropylene glycol methyl ether, tripropylene glycol methyl ether, propylene glycol ethyl ether, dipropylene glycol ethyl ether, tripropylene glycol ethyl ether, propylene glycol n-propyl ether (PnP), dipropylene glycol n-propyl ether, propylene glycol isopropyl ether, dipropylene glycol isopropyl ether, propylene glycol n-butyl ether, dipropylene glycol n-butyl ether, propylene glycol t-butyl ether, aromatic based-glycol ethers, ethylene glycol methyl ether acetate, diethyleneglycol methyl ether acetate, propylene glycol methyl ether acetate, dipropylene glycol methyl ether acetate and mixtures, thereof. These compounds are available from a number of sources including Dow Chemical Corp. and Arco Chemical Company, among others. The inclusion of equivalents of these glycol ethers and glycol ether acetates are also contemplated by the present invention.

Preferred glycol ethers and glycol ether acetates for use in the present invention have relatively high vapor pressures and low boiling points to facilitate the rapid drying of fabrics and the distillation of the rinse composition to remove any residual cleaning composition which may have been removed from the textiles/garments in the rinse step. The use of propylene glycol ethers and propylene glycol ether acetates are preferred with methyl ether (PM) and propylene glycol n-propyl ether (PnP) being especially preferred. These glycol ethers are especially useful for inclusion in rinse compositions which are used because they are infinitely soluble in water and therfore enable formation of azeotropes with sufficiently high flash points to make the composition utilitarian. Of the two glycol ethers, propylene glycol methyl ether (PM) is preferred because of its higher evaporation rate and vapor pressure, two properties which affect the distillation times and garment drying times in compositions according to the present invention which contain water. Propylene glycol methyl ether has an evaporation rate (nBuAc=1.00) of 0.71 and a vapor pressure (at 25° C. in mm Hg) of 12.5, whereas propylene glycol n-propyl ether has an evaporation rate of 0.21 and a vapor pressure of 1.7.

The term "dibasic ester(s)" is used in its normal definition to describe typical dialkyl esters of dicarboxylic acids (dibasic acids) capable of undergoing reactions of the ester group, including hydrolysis and saponification. Dibasic esters conventionally at low and high pH can be hydrolyzed to their corresponding dibasic acids and alcohols. Preferred dibasic ester solvents for use in the present invention include dimethyladipate, dimethyl glutarate, dimethyl succinate and mixtures, thereof. Other esters containing longer chain alkyl groups derived from alcohols, for example, ethyl, propyl, isopropyl, butyl, isobutyl, tert. butyl, amyl, isoamyl and mixtures, are also contemplated. The acid portion of the dibasic ester may be derived from such dibasic acids as oxalic, malonic pimelic, suberic and azelaic acids and mixtures thereof, including the preferred dibasic esters.

The term "dibasic ester(s)" is used in its normal definition to describe typical dialkyl esters of dicarboxylic acids (dibasic acids) capable of undergoing reactions of the ester group, including hydrolysis and saponification. Dibasic esters conventionally at low and high pH can be hydrolyzed to their corresponding dibasic acids and alcohols. Preferred. dibasic ester solvents for use in the present invention include dimethyladipate, dimethyl glutarate, dimethyl succinate and mixtures, thereof. Other esters containing longer chain alkyl groups derived from alcohols, for example, ethyl, propyl, isopropyl, butyl, isobutyl, tert. butyl, amyl, isoamyl and mixtures, are also contemplated. The acid portion of the dibasic ester may be derived from such dibasic acids as oxalic, malonic pimelic, suberic and azelaic acids and mixtures thereof, including the preferred dibasic esters. Dibasic acids may be optionally included in certain embodiments according to the present invention for their ability to provide an elevated $K_b$ value in order to enhance the grease-cleaning/removing characteristics of the present compositions.

Dibasic esters are commercially available from sources such as E.I. duPont de Nemours & Co., Inc., Wilmington, Del. under the tradenames DBE, DBE-2, DBE-3, DBE-4, DBE-5, DBE-6 and DBE-9 or Monsanto Company, St. Louis, Mo. under the tradenames Santosol™ DME, DME-2, DME-3, DMG, DMA and DMS. These preferred dibasic ester compositions generally are mixtures of dimethyl adipate, dimethyl glutarate, and dimethyl succinate in varying weight ratios, with the compositions including minor amounts (generally less than 0.5% by weight) of methanol and water. DBE-3, DBE-4 and DBE-5 are more preferred mixtures of the dibasic esters for use in the present invention. DBE-3 is a mixture containing approximately 85–95% by weight dimethyl adipate, 5–15% by weight dimethyl glutarate and no more than about 1% by weight dimethyl succinate. DBE-4 is a mixture containing no more than about 0.1% dimethyl adipate, no more than about 0.4% dimethyl glutarate and at least about 98% by weight dimethyl succinate. DBE-5 is a mixture containing at least about 0.2% dimethyl adipate, at least about 98% dimethyl glutarate and a maximum of about 1% dimethyl succinate.

In certain embodiments according to the present invention, the dibasic esters are included in the present compositions for their ability to solubilize fats, fatty acids and other hydrophobic contaminants which are to be removed from contaminated garments. The amount of dibasic ester which is included in the present compositions is that amount effective to substantially solubilize hydrophobic contaminants in the fabrics. In general, the amount of a dibasic ester included in the present compositions ranges from 0% to about 10% by weight, depending upon the application for which the composition is to be used.

Terpene compounds may also be included in the present cleaning compositions, primarily to boost the hydrophobic character of the compositions. As used herein, the term "terpene compound" refers to a class of acyclic and cyclic unsaturated compounds derived from natural essential oils and resins having at least 10 carbon atoms. Terpenes that find use in the present invention include alcohols and aldehydes as well as unsaturated hydrocarbons. Any number of terpene compounds, including combinations of these terpenes may be used in the present invention as optional compounds to promote or increase the hydrophobic character of the cleaning compositions according to the present invention.

Preferred terpene compounds for use in the present invention are represented by unsaturated hydrocarbons, alcohols and aldehydes having at least 10 carbon atoms and include alpha-terpinene, alpha-pinene, beta-pinene, delta-3-carene, citronellal, citronellol, hydroxycitronellal, d-limonene, linalool, gamma-terpinene, tetrahydrolinalool and terpineol, among others. Especially preferred terpenes for use in compositions of the present invention include alpha-terpinene and terpineol. A preferred terpineol for use in the present invention is Glidsol 175™ from Glidco (Jacksonville, Fla.) because of its highly hydrophobic character.

Compositions of the present invention comprise about 0% to about 20% by weight of a terpene compound, more preferably about 0% to about 15%, and even more preferably about 0% to about 6% by weight. The terpene compounds of the present invention are used in the above-defined weight ranges because these weight ranges are effective to increase the hydrophobic character of the compositions where applicable. Certain terpene compounds, such as d'limonene, are effective for instilling a pleasant citrus-like odor to the present compositions.

In certain preferred rinse compositions according to the present invention, especially for compositions used in cleaning operations advantageously employing microbial destruction such as in laboratories, hospitals, food preparation and health care facilities, among others, an antimicrobial agent optionally may be added to the last rinse step in amounts ranging from about 0.0001% to about 0.5%, preferably about 0.001% to about 0.15%, more preferably about 0.01% to about 0.1% by weight of the rinse composition. Preferred antimicrobial agents for use in the present invention include, for example, 2-bromo-2-nitro-1,3-propanediol, tris(hydroxy methyl)nitromethane, supplied by Angus Chemical Company under the registered trademarks MYACIDE S-2, MYACIDE AS PLUS, MYACIDE BT and BIOPAN CWT as well as the antimicrobial agents 7 A-ethyldihydro-1H,3H, 5H-oxazolo(3,4-C) oxazole (OXABAN E) and 4,4-dimethyloxazoladine (OXABAN A), also available from Angus Chemical Company.

The present cleaning composition advantageously has a specific gravity which is less than water, but higher than oil or grease. In preferred embodiments of the present invention, the choice of fatty acid ester or vegetable oil ester and surfactant(s) in combination with water will produce a cleaning composition, which, after use to clean oil or grease-soaked textiles or garments, will allow the oil or grease removed from the textiles or garments to float on top of the emulsion, thus making it easy to remove the top oil layer and regenerate or recycle cleaning composition for further use.

The pH of the cleaning compositions of the present invention may vary from somewhat acidic to somewhat alkaline within the range of about 3.5 to about 9.0. Preferred compositions generally have a substantially neutral pH in order to reduce the effect the compositions have on the textiles to be cleaned and the machine used to clean the garments. A pH of about 6.0 to about 8.0 is preferred, more preferably about 7.0. In producing the compositions of the present invention, there may be a desire to neutralize the compositions after formulation for maintaining stability.

Final compositions according to the present invention also include water in amounts generally ranging from about 20% to about 90% by weight, preferably about 40% to about 85% by weight, more preferably about 50% to about 85% by weight, even more preferably about 60% to about 85% by weight and most preferably about 65% to about 80% by weight. Water is included within the compositions according to the present invention for its benefit in solubilizing water-soluble stains and other textile contaminants such as certain foods, blood, other biological fluids, etc. In addition, water is generally one of the least expensive components used in the present invention, thus making compositions more cost effective and economically viable as more water is used.

Final cleaning compositions according to the present invention are preferably characterized by containing very little, if any, volatile organic compounds (VOC) and by being biodegradable and substantially non-toxic with a very high or no flash point.

Cleaning or rinse compositions according to the present invention may also include a fabric finishing agent such as oleic acid, stearyl alcohol, or lanolin, among others, in amounts ranging from about 0.001% to about 3.5% by weight, more preferably about 0.05% to about 0.5% by weight.

In producing the present compositions, the individual components may be added in any order and stirred to provide a completely mixed product. In most instances, before inclusion of water, the cleaning composition is clear at room temperature. In certain instances, the product may be hazy to slightly hazy at room temperature, but may become clear after the temperature is raised somewhat above room temperature. Generally, after the inclusion of water, the emulsion tends to be slightly milky to milky in appearance.

The present compositions may be used as cleaning compositions, for example, in dry cleaning methods for cleaning clothes and other textile materials including carpeting and related materials, as spot removers before a cleaning operation is carried out on clothing, carpeting and related materials, as oil and grease removers (hydrophobic composition removers) or degreasers either in clothing or on machinery and tools, and as general cleaners. Other applications readily apparent to one of ordinary skill in the art are also contemplated for use with the present compositions.

Certain compositions according to the present invention find particularly favorable use as suitable replacements for perchlorethylene, mineral spirits, CFC's and other somewhat toxic and non-biodegradable solvents which are traditionally used in dry cleaning operations. Preferred compositions according to the present invention may be used with minor modification to existing dry cleaning equipment, for example, equipment supplied by Böwe Machinenfabrik GMBH, Augsburg, Germany, Multi-Matic Corp., Montvale, N.J. and Grace Equipment Corp., Woodbury, N.Y., among others.

In a cleaning method according to the present invention, clothing or other textile-containing materials are exposed to one or more of the cleaning compositions according to the present invention preferably at a temperature above room temperature, more preferably at about 35° C. to about 70° C., even more preferably about 55–65° C. within this range for a time sufficient for cleaning or removing at least a substantial portion of the contaminent(s) in the clothing or other material to be cleaned. The first wash cycle can last anywhere from about 30 seconds to as long as 30 minutes or longer, with a wash cycle of about 10 minutes being preferred. After at least one wash cycle (and preferably only one cycle), the textiles are then exposed to a rinse composition according to the present invention in at least one rinse cycle (preferably, at least two rinse cycles) for a period of time sufficient to remove substantially all of the cleaning composition from the textiles. Generally, each rinse cycle ranges from about several minutes to 20 minutes, preferably about 8 to 15 minutes. In preferred embodiments, the washed textiles are subjected to three consecutive rinse cycles, in order to remove residual wash compositions from the textiles. The total wash and rinse cycles of the present method generally range from about 10 minutes to up to an hour, with a preferred method lasting about 35 to 50 minutes, more preferably about 40 to 45 minutes. After the rinse cycle(s), described above, the textiles are then dried at elevated temperatures for a period sufficient to substantially remove any remaining rinse composition from the textiles. The temperature of the drying step may range broadly from just above room temperature up to 90° C. or more, with a preferred temperature falling within the range of about 38° C. to about 85° C., depending upon the volatility of the rinse composition which is used for the rinse cycle, with lower volatility rinse compositions requiring drying cycles at temperates above about 60–65° C.

In the present method, after each wash cycle or step, the cleaning composition is extracted from the clothes within the cleaning machine using a high rpm extraction or spin cycle and optionally is sent to a gravity separator. In preferred embodiments according to the present invention, oil, grease and dirt which are removed from the textiles during the wash cycle appear in a top layer of cleaning composition which is extracted from the washed textiles during the extraction step. The oil is then separated from the remaining cleaning composition which is recycled for use in further wash cycles.

Likewise, the rinse composition is extracted from the textiles after a rinse step and recycled for further use. After being employed in a number of rinse cycles, the rinse composition is thereafter distilled at elevated temperatures generally ranging from about 50° C. to 120° C. or more, more preferably from about 90° C. to about 105° C. Any oil and grease, which was not removed from the textiles during the wash cycle(s) and has been removed from the textiles during the rinse cycle(s), will remain in the still after the rinse composition is distilled.

After the above-described separation or distillation steps, the cleaning or rinse composition, in certain instances, may contain an enrichment of components which is not ideal for further cleaning or rinsing. Although in most instances, the recycled cleaning composition and/or distilled rinse composition may be used directly without further modification, in certain instances it may be desirable to add one or more individual components to the recycled and/or distilled composition in order to reconstitute the composition. Consequently, in certain instances, after separation or distillation, the cleaning compositions and/or rinse compositions may be reconstituted or regenerated with surfactant and/or higher boiling cosolvents, which separated out from the compositions or did not distill with the other components of the composition. Therefore, the present invention also contemplates the reconstitution or regeneration of the cleaning and/or rinse compositions according to the present invention after a separation or distillation step, comprising adding to the separated or distilled composition a reconstitution composition comprising a vegetable oil ester or fatty acid ester, a surfactant and optionally, water, with the amounts of the vegetable oil ester or fatty acid ester and surfactant in the reconstitution composition falling within the range of about 10% to about 90% by weight for each component (i.e., vegetable oil ester, or fatty acid ester and one or more surfactants), depending upon what component has been lost, with the remainder being comprised of the other components of the cleaning or rinse composition in weight ratios consistent to bring the recycled or distilled composition to its original formulation. In the case of the inclusion of water in the cleaning composition, it may be added in an amount representing at least about 30% and up to 95% by weight of the reconstitution composition, preferably at least about 50% by weight within this range.

The present method is now described with reference to the embodiment depicted in the drawing (FIG. 1). By way of example, a preferred method according to the present invention makes use of a cleaning machine such as that generally described by the schematic set forth in the drawing. Preferably, the commercial or industrial cleaning machine should have at least four tanks 2, 6, 7, 8 with tank capacities between about 200 and 400 pounds per tank. Each tank should be equipped with the capability to be heated to 70° C. (160° F.) or higher. The machine should also be equipped with spin disc or centrifugal filters 5 or equivalent filters for particulate removal and a gravity separator 3 with volume capacity equal to that of a work tank 2 containing the wash composition.

As exemplified by the cleaning machine depicted in the drawing, textiles or garments to be laundered are loaded into a basket 1 which is charged with cleaning composition from work tank 2 at a temperature of 55 to 65° C. for a wash cycle of about 10 minutes. After the wash cycle, the used cleaning composition is extracted and discharged back into work tank 2 and then into gravity separator 3. Gravity separator 3, when heated to temperatures above about 70° C. (about 170° F.), causes the oil to separate from the solution. Gravity separator 3 is desirably equipped with a sight glass to facilitate observation of the collected oil. Because the preferred composition has a greater density than that of the separated oils, separator 3 may be equipped with a device which senses the difference in density at the separation level and automatically opens a valve (not illustrated) to bottom drain cleaning composition back to work tank 2. The oil can then be directed to oil collector or repository 4 for sale as a waste fuel for its heat value. Optionally, the cleaning composition in gravity separator 3 may be directed from the gravity separator into centrifugal or spin filter 5 to remove particulates in the cleaning composition before recycling cleaning composition to work tank 2. When it is evident (by virtue of the color of the cleaning composition) that particulate is contaminating the solution in work tank 2, the cleaning composition is directed into centrifugal filter 5 and then back to work tank 2.

After the textiles are exposed to cleaning composition in basket 1 and the cleaning composition is extracted therefrom, basket 1 (containing washed textiles or fabrics) is charged with rinse composition from primary rinse tank 6 and exposed to rinse composition for a period sufficient to remove a substantial amount of cleaning composition which remains in the washed textiles (most preferably, about 8–10 minutes). The rinse composition is extracted from the rinsed textiles and discharged back into primary rinse tank 6. Subsequently, rinse composition from secondary rinse tank 7 is directed to basket 1 and a second rinse cycle is performed. The rinse composition used in this second rinse cycle is extracted from the rinsed textiles and discharged back into secondary rinse tank 7. Thereafter, rinse composition from tertiary rinse tank 8 is delivered to basket 1 and another rinse cycle is performed (extract rinse composition and discharge into tank from which composition came). Optionally, the cleaning machine may be outfitted with additional rinse tanks, depending upon the number of desired rinse cycles or subcycles and cleaning approach desired.

After the last rinse cycle, the textiles are dried at elevated temperature (most preferably at temperatures of about 75° to about 90° C.) for a period sufficient to dry the textiles (generally about 10 minutes to about 30 minutes). The total washing, rinsing and drying cycles will take about twenty minutes to about one hour or more and preferably fall within the range of about 30 to 45 minutes.

Rinse composition is directed to a still 9 from secondary rinse tank 7 when required. Alternatively, as illustrated in the drawing, rinse composition is directed to still 9 from basket 1 at the end of a rinse portion of a cleaning cycle (a "rinse cycle"). The distilled or cleaned rinse composition is pumped from still 9 to secondary rinse tank 7. Subsequently, that cleaned or decontaminated rinse composition is shifted to primary rinse tank 6 in preparation for feeding to basket 1.

Distillation in still 9 occurs at elevated temperatures and preferably within the range of about 50° C. to 120° C. or more, more preferably about 90° C. to about 105° C. Any oil and grease, which was not removed from the textiles during the wash cycle(s) and was removed from the textiles during the rinse cycle(s), will remain in the still after the rinse composition is distilled. Still 9 may have a plug or opening at its bottom to drain any oil or grease which remains after distillation. In preferred embodiments, rinse composition from secondary rinse tank 7 is directed to the still. After distillation, rinse composition from the still is directed to tertiary rinse tank 8 (or a higher rinse tank) and rinse composition from tertiary rinse tank 8 is directed to secondary rinse tank 7. Rinse composition in secondary rinse tank 7 is generally directed to primary rinse tank 6 or if distillation is needed, to still 9. The sequencing is such that distillation and oil separation will occur from the rinse solution directed from secondary rinse tank 7.

For antimicrobial cleaning, a decontamination tank may be used as work tank 2 and a second work tank (not shown)

may be designated as a second cleaning tank. An additional rinse tank may be used in such embodiments for receiving an antimicrobial rinse composition. In this decontamination method, a first washing step involves the transfer of antimicrobial cleaning composition from work tank 2 into basket 1 for washing at elevated temperature (preferably, 160° C. to 180° C. for about 5–10 minutes). After extraction and discharge, the used cleaning composition is returned to work tank 2. A second washing step utilizes cleaning composition from the second work tank (not shown) which, after cleaning and extraction, is returned to the second work tank. Rinse steps follow in much the same fashion as described above, except that one or more of the rinse compositions may contain antimicrobial agent as is used in the cleaning compositions.

Work tank 2 has a nominal capacity of 60 gallons, while rinse tanks 6, 7, and 8 each have a nominal capacity of 80 gallons. Pumps (not illustrated) are provided for moving the wash and rinse compositions along transfer pipes shown in the drawing. In a fully automated system, a programmer or microprocessor control (not illustrated) is operatively connected to the pumps and any associated valves for activating the pumps and valves at appropriate junctures during a cleaning cycle (which includes at least one wash cycle and at least one rinse cycle). In addition, density sensors (not shown) and other detectors such as electrical sensors (not shown) may be provided for automatically monitoring grease and oil levels in tanks 2, 6, 7, and 8 and optionally gravity separator 3. The sensors and detectors may be connected to the microprocessor control for inducing the appropriate pump and valve activation.

Solid connection lines in the drawing represent pipes or flow paths along which cleaning composition (wash or rinse composition) is guided during each cleaning cycle. Dashed connection lines represent pipes or flow paths along which cleaning composition optionally flows, depending on the requirements of the particular cleaning task.

The present invention also relates to methods of degreasing metal surfaces, especially tools and related metal exposed to grease, oil and related materials using the cleaning and/or rinse compositions according to the present invention. Degreasers are used to remove grease, oil, soot, soil or related hydrophobic materials primarily of petroleum or hydrocarbon origin from a metal surface by simply exposing the surface to the degreaser and then removing the grease from the surface for example, by wiping or using some other method.

The following examples are provided to illustrate the present invention and should not be misunderstood to limit the scope of the present invention in any way.

EXAMPLES

The task was to prepare compositions which emulate the performance characteristics of perchlorethylene, but which did not suffer from the same disadvantages. The compositions should have a sufficient $K_B$ value to enable them to solubilize fats and fatty acids and be sufficiently hydrophilic to reject and ultimately separate from oil, grease and other contaminants which are removed from garments and textiles exposed to the described compositions. In addition, the present compositions advantageously have a sufficiently high flash point to render them operationally harmless from ignition or explosion, have a relatively neutral pH, remain stable after repeated cycles, are biodegradable and relatively non-toxic and be sufficiently compatible with most classifications of garment fabrics especially cottons and related textiles which are used in gloves and uniforms within an industrial context.

The following compositions were made and assessed for their ability to clean typical contaminants from textiles and for their solvent effect on typical textiles and fabrics used in industrial gloves and uniforms and the like. In addition, the compositions were generally assessed for their ability to separate from fatty acids, fat contaminants, oil, grease and other contaminants in one or more distinct, separate layer(s).

The following components were used in the following examples to produce compositions exemplary of the present invention. Triethanolamine (TEA) was obtained from Dow Chemical Co., Midland, Mich. Other substituted amines, such as diethyl amine (DEA) were also used in a number of examples. Soybean oil methyl ester was obtained from AG Environmental. NP-6 (polyoxyethylenenonylphenol), one of a group of polyoxyethylated alkyl phenols, was obtained from Chemax, Inc., Greenville, S.C. Linear dodecylbenzene sulfonic acid (DBSA) was obtained from Witco, Houston, Tex. PD-600, a phosphate surfactant, also was obtained from Chemax, Inc.

In producing the compositions, the individual components may be added and stirred to provide a completely mixed product. In the following examples, for the most part, the components were added in the order in which they appear, except that the triethanolamine and dodecylbenzenesulfonic acid are added to produce the acid/base reaction product of these two components. Water was generally added last in order to determine the amount of water which was compatible with the other components. Generally, about 2 to 4 parts by weight of water was added to the compositions (preferably about 4 parts or 80% by weight of the final composition which includes water) which are set forth below. In most instances, the product was clear at room temperature. In certain instances, the product was hazy to slightly hazy at room temperature, but generally became clear after the temperature was raised somewhat above room temperature.

| COMPONENT | WEIGHT PERCENT |
|---|---|
| EXAMPLE 1 | |
| SOYBEANOIL METHYL ESTER | 80.00 |
| NP-6[1] | 5.00 |
| TEA[2] | 5.00 |
| DBSA[3] | 5.00 |
| PD-600[4] | 5.00 |
| EXAMPLE 2 | |
| SOYBEAN OIL METHYL ESTER | 85.00 |
| NP-6 | 3.75 |
| TEA | 3.75 |
| DBSA | 3.75 |
| PD-600 | 3.75 |
| EXAMPLE 3 | |
| SOYBEAN OIL METHYL ESTER | 75.00 |
| NP-6 | 6.25 |
| TEA | 6.25 |
| DBSA | 6.25 |
| PD-600 | 6.25 |
| EXAMPLE 4 | |
| SOYBEAN OIL METHYL ESTER | 80.00 |
| NP-4 | 5.00 |
| TEA | 5.00 |
| DBSA | 5.00 |
| PD-600 | 5.00 |

-continued

| COMPONENT | WEIGHT PERCENT |
|---|---|
| EXAMPLE 5 | |
| SOYBEAN OIL METHYL ESTER | 85.00 |
| NP-4 | 3.75 |
| TEA | 3.75 |
| DBSA | 3.75 |
| PD-600 | 3.75 |
| EXAMPLE 6 | |
| SOYBEAN OIL METHYL ESTER | 85.00 |
| NP-9 | 3.75 |
| TEA | 3.75 |
| DBSA | 3.75 |
| PD-600 | 3.75 |
| EXAMPLE 7 | |
| SOYBEAN OIL METHYL ESTER | 80.00 |
| NP-9 | 5.00 |
| TEA | 5.00 |
| DBSA | 5.00 |
| PD-600 | 5.00 |
| EXAMPLE 8 | |
| SOYBEAN OIL METHYL ESTER | 75.00 |
| NP-9 | 6.25 |
| TEA | 6.25 |
| DBSA | 6.25 |
| PD-600 | 6.25 |
| EXAMPLE 9 | |
| SOYBEAN OIL METHYL ESTER | 80.00 |
| NP-10 | 5.00 |
| TEA | 5.00 |
| DBSA | 5.00 |
| PD-600 | 5.00 |
| EXAMPLE 10 | |
| SOYBEAN OIL METHYL ESTER | 75.00 |
| NP-10 | 6.25 |
| TEA | 6.25 |
| DBSA | 6.25 |
| PD-600 | 6.25 |
| EXAMPLE 11 | |
| SOYBEAN OIL METHYL ESTER | 85.00 |
| NP-10 | 3.75 |
| TEA | 3.75 |
| DBSA | 3.75 |
| PD-600 | 3.75 |
| EXAMPLE 12 | |
| SOYBEAN OIL METHYL ESTER | 80.00 |
| NP-6 | 5.00 |
| DEA | 5.00 |
| DBSA | 5.00 |
| PD-600 | 5.00 |
| EXAMPLE 13 | |
| SOYBEAN OIL METHYL ESTER | 85.00 |
| NP-6 | 3.75 |
| DEA | 3.75 |
| * DBSA | 3.75 |
| PD-600 | 3.75 |
| EXAMPLE 14 | |
| SOYBEAN OIL METHYL ESTER | 75.00 |
| NP-6 | 6.25 |
| DEA | 6.25 |
| DBSA | 6.25 |
| PD-600 | 6.25 |
| EXAMPLE 15 | |
| SOYBEAN OIL METHYL ESTER | 80.00 |
| NP-10 | 5.00 |
| DEA | 5.00 |
| DBSA | 5.00 |
| PD-600 | 5.00 |

-continued

| COMPONENT | WEIGHT PERCENT |
|---|---|
| EXAMPLE 16 | |
| SOYBEAN OIL METHYL ESTER | 75.00 |
| NP-10 | 6.25 |
| DEA | 6.25 |
| DBSA | 6.25 |
| PD-600 | 6.25 |
| EXAMPLE 17 | |
| SOYBEAN OIL METHYL ESTER | 85.00 |
| NP-10 | 3.75 |
| DEA | 3.75 |
| DBSA | 3.75 |
| PD-600 | 3.75 |
| EXAMPLE 18 | |
| SOYBEAN OIL METHYL ESTER | 80.00 |
| NP-9 | 5.00 |
| DEA | 5.00 |
| DBSA | 5.00 |
| PD-600 | 5.00 |
| EXAMPLE 19 | |
| SOYBEAN OIL METHYL ESTER | 85.00 |
| NP-9 | 3.75 |
| DEA | 3.75 |
| DBSA | 3.75 |
| PD-600 | 3.75 |
| EXAMPLE 20 | |
| SOYBEAN OIL METHYL ESTER | 75.00 |
| NP-9 | 6.25 |
| DEA | 6.25 |
| DBSA | 6.25 |
| PD-600 | 6.25 |
| EXAMPLE 21 | |
| SOYBEAN OIL METHYL ESTER | 80.00 |
| NP-4 | 5.00 |
| DEA | 5.00 |
| DBSA | 5.00 |
| PD-600 | 5.00 |
| EXAMPLE 22 | |
| SOYBEAN OIL METHYL ESTER | 85.00 |
| NP-4 | 3.75 |
| DEA | 3.75 |
| DBSA | 3.75 |
| PD-600 | 3.75 |
| EXAMPLE 23 | |
| SOYBEAN OIL METHYL ESTER | 75.00 |
| NP-4 | 6.25 |
| DEA | 6.25 |
| DBSA | 6.25 |
| PD-600 | 6.25 |
| EXAMPLE 24 | |
| SOYBEAN OIL METHYL ESTER | 80.00 |
| NP-6 | 5.00 |
| MEA | 5.00 |
| DBSA | 5.00 |
| PD-600 | 5.00 |
| EXAMPLE 25 | |
| SOYBEAN OIL METHYL ESTER | 85.00 |
| NP-6 | 3.75 |
| MEA | 3.75 |
| DBSA | 3.75 |
| PD-600 | 3.75 |
| EXAMPLE 26 | |
| SOYBEAN OIL METHYL ESTER | 75.00 |
| NP-6 | 6.25 |
| MEA | 6.25 |

-continued

| COMPONENT | WEIGHT PERCENT |
|---|---|
| DBSA | 6.25 |
| PD-600 | 6.25 |

[1]NP-6 One of a group of polyoxyethylated alkyl phenols which are useful in the present invention. Both octyl and nonyl phenol ethoxylates with from 1.5 to 70 moles of ethylene oxide are useful.
[2]Denotes triethanolamine, although other amines may appear in the examples.
[3]DBSA denotes linear dodecylbenzene sulfonic acid although linear alkylbenzene sulfonic acids with alkyl chain lengths of varying carbon atoms are useful.

Testing of Compositions

The compositions cited in the above examples were made and evaluated in Multimatic™ Dry cleaning machines to test their ability to clean "worst-case" contaminants usually found on textiles. The textiles typically are composed of cotton and cotton synthetic mixtures of the type usually found in industrial uniforms. The wash and rinse compositions were sufficiently efficacious to solubilize contaminants which, prior to the present invention, required a composition of sufficiently high $K_B$ such as perchlorethylene or alternatively, required laundering in order to accomplish cleaning. Experiments utilizing rinse compositions, and in particular a composition comprising approximately 35% by weight propylene glycol methyl ether and about 65% water after a first cleaning step, were advantageous for substantially eliminating the possibility of textile shrinkage during a subsequent drying step at high temperatures.

The cycle times utilizing the cited compositions were comparable to those of machines utilizing perchlorethylene. Oil extracted during processing was handled and diposed of as non-hazardous waste, and replenishing of wash and rinse compositions due to extraction losses or distillation only required augmenting those solutions with virgin materials.

Results

After making and analyzing the above examples, the following conclusions can be drawn:

1. The use of vegetable oil esters or fatty acid esters in combination with the surfactant systems in an aqueous system produced excellent cleaning characteristics.

2. A composition which contained approximately 80% water and 20% of the remaining compositions was preferred, although the ratio of water could be reduced to significantly less than 65% by weight. The use of triethanolamine, in contrast to other amines, was clearly preferred in the present invention. The inclusion of dodecylbenzene sulfonic acid and phosphate ester surfactant (PD600) was clearly preferred as was the inclusion of nonylphenol ethoxylate surfactants.

3. The cleaning and/or rinse compositions could be shown to be readily recycled in many instances, by simply skimming off oil or grease obtained during the cleaning step.

3. Rinse compositions which utilized a mixture of propyleneglycol methyl ether (PM) and water at a ratio of about 35:65 were particularly advantageous.

It is to be understood that the examples and embodiments described hereinabove are for the purposes of providing a description of the present invention by way of example and are not to be viewed as limiting the present invention in any way. Various modifications or changes that may be made to that described hereinabove by those of ordinary skill in the art using equivalents of components specifically described in the present invention are also contemplated by the present invention and are to be included within the spirit and purview of this application and the following claims.

What is claimed is:

1. A composition for use as a cleaning or degreasing composition consisting essentially of:

i. a vegetable oil ester or a fatty acid ester in an amount ranging from about 5% to about 70% by weight of said composition;

ii. a glycol ether or glycol ether acetate in an amount ranging from about 5% to about 35% by weight of said composition;

iii. at least one surfactant in an amount ranging from about 0.001% to about 25% by weight of said composition; and iv. water in an amount ranging from about 20% to about 95% by weight of said composition, said composition being in the form of an emulsion.

2. The composition according to claim 1 wherein said surfactant is including said composition in an amount ranging from about 0.2% to about 25%.

3. The composition according to claim 1 wherein said surfactant is including in said composition in an amount ranging from about 0.25% to about 25%.

4. The composition according to claim 1 wherein said vegetable oil ester or fatty acid ester is included in said composition in an amount ranging from about 10% to about 65% by weight.

5. The composition according to claim 1 wherein said vegetable oil ester or fatty acid ester is included in said composition in an amount ranging from about 15% to about 45% by weight.

6. The composition according to claim 1 having a density less than that of water.

7. The composition according to claim 1 having a BOD of greater than about 20 ppm.

8. The composition according to claim 1 having a BOD of greater than about 40 ppm.

9. The composition according to claim 1 wherein said water ranges from about 50% to about 85% by weight.

10. The composition according to claim 1 wherein said vegetable oil ester or fatty acid ester is a methyl ester.

11. The composition according to claim 10 wherein said vegetable oil ester is soybean oil methyl ester.

12. The composition according to claim 1 wherein said vegetable oil ester comprises about 10% to about 35% by weight of said composition and said surfactant comprises at least one zwitterionic surfactant.

13. The composition according to claim 12 wherein said vegetable oil ester is soybean oil methyl ester and said zwitterionic surfactant comprises triethanolammonium dodecylbenzenesulfonate.

14. The composition according to claim 1 wherein said vegetable oil is selected from the group consisting of almond, avocado, castor, coconut, corn, cottonseed, olive, peanut, persic, rice bran, safflower, sesame, soybean, sunflower and walnut oils.

15. The composition according to claim 1 wherein said zwitterionic surfactant includes the reaction product of an amine and a fatty sulfonic acid.

16. The composition according to claim 15 wherein said zwitterionic surfactant is triethanolammonium dodecylbenzenesulfonate.

17. The composition according to claim 15 wherein said zwitterionic surfactant includes the reaction product of a phosphate monoester or diester and an amine.

18. The composition according to claim 17 wherein said amine is triethanolamine.

19. The composition according to claim 13 wherein said zwitterionic surfactant includes the reaction product of an alkyl phosphate monoester or diester and a triethanolamine.

20. The composition according to claim 1 wherein said vegetable oil ester is included in said composition in an amount ranging from about 10% to about 35% by weight of said composition, said surfactant consists essentially of a mixture of a zwitterionic surfactant and nonylphenol ethoxylate surfactant and is included in said composition in an amount ranging from about 5% to about 10% by weight of said composition.

* * * * *